US009330816B2

(12) United States Patent
Deighton et al.

(10) Patent No.: US 9,330,816 B2
(45) Date of Patent: May 3, 2016

(54) UMBILICAL

(75) Inventors: Alan Deighton, Sunderland (GB); David Fogg, Newcastle Upon Tyne (GB)

(73) Assignee: TECHNIP FRANCE (FR)

( * ) Notice: Subject to any disclaimer, the term of this patent is extended or adjusted under 35 U.S.C. 154(b) by 299 days.

(21) Appl. No.: 12/812,323

(22) PCT Filed: Jan. 6, 2009

(86) PCT No.: PCT/GB2009/000007

§ 371 (c)(1),
(2), (4) Date: Sep. 23, 2010

(87) PCT Pub. No.: WO2009/087363

PCT Pub. Date: Jul. 16, 2009

(65) Prior Publication Data

US 2011/0005795 A1 Jan. 13, 2011

(30) Foreign Application Priority Data

Jan. 10, 2008 (GB) ..... 0800386.5

(51) Int. Cl.
*H01B 7/00* (2006.01)
*H01B 7/04* (2006.01)

(52) U.S. Cl.
CPC ..... *H01B 7/045* (2013.01); *Y10T 29/49117* (2015.01)

(58) Field of Classification Search
None
See application file for complete search history.

(56) References Cited

U.S. PATENT DOCUMENTS

| | | | | | |
|---|---|---|---|---|---|
| 3,596,139 | A | * | 7/1971 | Walsh | 174/562 |
| 4,597,345 | A | | 7/1986 | Reeser et al. | 114/20 R |
| 4,719,319 | A | * | 1/1988 | Tighe, Jr. | 174/103 |
| 4,783,576 | A | * | 11/1988 | Silver et al. | 174/25 R |
| 4,891,256 | A | | 1/1990 | Kite, III et al. | 428/36.1 |
| 5,191,173 | A | | 3/1993 | Sizer et al. | |
| 5,495,547 | A | * | 2/1996 | Rafie et al. | 385/101 |
| 5,661,842 | A | * | 8/1997 | Faust | 385/139 |
| 5,735,127 | A | * | 4/1998 | Pfotenhauer et al. | 62/6 |
| 5,902,958 | A | * | 5/1999 | Haxton | 174/47 |
| 6,012,495 | A | * | 1/2000 | Antonsen | 138/131 |
| 6,100,467 | A | * | 8/2000 | Kroulik | 174/15.1 |
| 6,395,975 | B1 | * | 5/2002 | Bosisio et al. | 174/25 R |
| 6,472,614 | B1 | * | 10/2002 | Dupont et al. | 174/70 S |

(Continued)

FOREIGN PATENT DOCUMENTS

| | | |
|---|---|---|
| DE | 976 282 | 6/1963 |
| EP | 0 884 451 | 11/1999 |

(Continued)

OTHER PUBLICATIONS

International Search Report mailed May 20, 2009, in corresponding International Application No. PCT/GB2009/000007.

(Continued)

*Primary Examiner* — Hoa C Nguyen
*Assistant Examiner* — Xanthia C Cunningham
(74) *Attorney, Agent, or Firm* — Ostrolenk Faber LLP

(57) ABSTRACT

An umbilical for use in the offshore production of hydrocarbons comprising an assembly of functional elements wherein at least one of the functional elements comprises an electrical cable, and wherein said electrical cable is enclosed within a tube, said tube being adapted to apply a radial compressive force on the cable whereby the tube is capable of supporting the weight of the electrical cable in an axial direction.

16 Claims, 7 Drawing Sheets

(56) References Cited

U.S. PATENT DOCUMENTS

| | | | | |
|---|---|---|---|---|
| 6,943,300 | B2 * | 9/2005 | Ekeberg et al. | 174/113 R |
| 7,049,517 | B2 * | 5/2006 | McCarthy et al. | 174/68.3 |
| 7,158,703 | B2 * | 1/2007 | Mjelstad | 385/101 |
| 7,239,781 | B2 * | 7/2007 | Chartier et al. | 385/103 |
| 7,242,831 | B2 * | 7/2007 | Fee | 385/103 |
| 7,295,735 | B2 * | 11/2007 | Kim et al. | 385/113 |
| 7,473,844 | B2 * | 1/2009 | Figenschou et al. | 174/47 |
| 7,706,640 | B2 * | 4/2010 | Pizzorno et al. | 385/12 |
| 7,754,966 | B2 * | 7/2010 | Figenschou | 174/47 |
| 7,798,234 | B2 * | 9/2010 | Ju et al. | 166/367 |
| 2003/0026559 | A1 * | 2/2003 | VanVickle et al. | 385/112 |
| 2003/0059183 | A1 * | 3/2003 | Militaru | 385/112 |
| 2005/0121094 | A1 * | 6/2005 | Quigley et al. | 138/125 |
| 2006/0127015 | A1 * | 6/2006 | Donetti et al. | 385/112 |
| 2006/0137880 | A1 * | 6/2006 | Figenschou et al. | 166/367 |
| 2006/0159408 | A1 * | 7/2006 | Kim et al. | 385/109 |
| 2006/0193572 | A1 | 8/2006 | Mjelstad | |
| 2006/0201698 | A1 * | 9/2006 | Mjelstad | 174/113 C |
| 2007/0181333 | A1 * | 8/2007 | Belli et al. | 174/105 R |
| 2007/0205009 | A1 * | 9/2007 | Figenschou | 174/47 |
| 2008/0283272 | A1 * | 11/2008 | Huston et al. | 174/110 PM |
| 2009/0145657 | A1 * | 6/2009 | Hartnack et al. | 174/535 |
| 2009/0211805 | A1 * | 8/2009 | Roseen et al. | 174/650 |
| 2010/0059247 | A1 * | 3/2010 | de Oliveira Lima et al. | 174/103 |
| 2010/0227764 | A1 * | 9/2010 | Willen et al. | 505/163 |

FOREIGN PATENT DOCUMENTS

| | | |
|---|---|---|
| GB | 2 316 990 | 3/1998 |
| GB | 2 322 392 | 8/1998 |
| GB | 2 326 536 | 12/1998 |
| GB | 2 353 894 | 3/2001 |
| WO | WO 93/17176 | 9/1993 |
| WO | WO 2005/124213 | 12/2005 |
| WO | WO 2007/034242 | 3/2007 |

OTHER PUBLICATIONS

Notification Concerning Transmittal of International Preliminary Report on Patentability with a mailing date of Jul. 22, 2010, International Preliminary Report on Patentability, Written Opinion of the International Searching Authority issued in corresponding International Application No. PCT/GB2009/000007.

UK Search Report dated Apr. 14, 2008, issued in corresponding UK Application No. GB0800386.5.

* cited by examiner

UMBILICAL

CROSS REFERENCE TO RELATED APPLICATIONS

The present application is a 35 U.S.C. §371 National Phase conversion of PCT/GB2009/000007, filed Jan. 6, 2009, which claims benefit of British Application No. 0800386.5, filed Jan. 10, 2008, the disclosure of which is incorporated herein by reference. The PCT International Application was published in the English language.

BACKGROUND OF THE INVENTION

The present invention relates to an umbilical for use in the offshore production of hydrocarbons, and in particular to a power umbilical for use in deep water applications.

An umbilical consists of a group of one or more types of elongated active umbilical elements, such as electrical cables, optical fibre cables, steel pipes and/or hoses, cabled together for flexibility, over-sheathed and, when applicable, armoured for mechanical strength. Umbilicals are typically used for transmitting power, signals and fluids (for example for fluid injection, hydraulic power, gas release, etc.) to and from a subsea installation.

The umbilical cross-section is generally circular, with the elongated elements being wound together either in a helical or in a S/Z pattern. In order to fill the interstitial voids between the various umbilical elements and obtain the desired configuration, filler components may be included within the voids.

The API (American Petroleum Institute) 17E "Specification for Subsea Umbilicals" provides standards for the design and manufacture of such umbilicals.

Subsea umbilicals are being installed at increasing water depths, commonly deeper than 2000 m. Such umbilicals have to be able to withstand the increasingly severe loading conditions during their installation and their service life.

The main load bearing components in charge of withstanding the axial loads caused by the weight and movements of the umbilical are steel pipes (see U.S. Pat. No. 6,472,614, WO93/17176 and GB2316990), steel rods (see U.S. Pat. No. 6,472,614), composite rods (see WO2005/124213), or tensile armour layers (see FIG. 1 of U.S. Pat. No. 6,472,614).

The other elements, i.e. the electrical and optical cables, the thermoplastic hoses, the polymeric external sheath and any polymeric filler components, do not contribute significantly to the tensile strength of the umbilical.

Electrical cables used in subsea umbilicals fall into two distinct categories respectively known as power cables and signal cables.

Power cables are used for transmitting high electrical power (typically a few MW) to powerful subsea equipment such as pumps. Power cables are generally rated at a medium voltage between 6 kV and 35 kV. A typical prior art power cable is illustrated in FIG. 1 of the accompanying drawings. From the inside to the outside, it comprises a central copper conductor 2*a*, three semi-conductor and electrical insulation layers 2*b*, a metallic foil screen 2*c* and an external polymeric sheath 2*d*. The central conductor 2*a* generally has a stranded construction and a large section typically comprised between 50 $mm^2$ and 400 $mm^2$. Three phase power can be provided by three such cables bundled together within the umbilical structure.

Signal cables are generally used for transmitting signals and low power (<1 kW) to electrical devices on the seabed. Signal cables are generally rated at a voltage smaller than 3000V, and typically smaller than 1000V. Signal cables generally consist of small section insulated conductors bundled together as pairs (2), quads (4) or, very rarely, any other number, said bundle being further over-sheathed.

An example of a prior art quad signal cable is illustrated in FIG. 2 of the accompanying drawings. FIG. 2 shows four small size stranded copper conductors 3*a* individually over-sheathed by polymeric insulation layers 3*b* and helically bundled together. A polymeric filler material 3*c* is added to fill the voids in the bundle and to achieve a cylindrical shape. This arrangement is optionally surrounded by an electromagnetic shielding 3*g* made from a wrapped copper or aluminium foil. A polymeric external sheath 3*d* protects the cable against mechanical damage and water ingress.

The copper conductors of electrical cables are not load-bearing components, because of the low tensile strength of copper. These copper conductors effectively only add weight to the umbilical. Unless protected, these electrical conductors may therefore be damaged by excessive elongation or crushing, especially under severe conditions such as in deep water and/or in dynamic umbilicals.

SUMMARY OF THE INVENTION

An object of the present invention is to solve this problem and provide an umbilical comprising power cables and/or signal cables which can be used in dynamic and/or deep water applications.

A prior art solution to this problem consists in reinforcing each electrical cable by helically winding around it at least a layer of steel armour wires as an armouring layer. FIG. 3 of the accompanying drawings illustrates a prior art signal cable similar to the one represented in the accompanying FIG. 2, but comprising in addition such an armouring layer 3*h*, generally located under the polymeric external sheath 3*d*. However, the armouring process is expensive and time consuming.

US2006/0193572 discloses a deep water umbilical comprising an electrical signal cable protected by a steel tube enclosing it. The inner diameter of the steel tube is larger than the outer diameter of the cable, so that there is a gap in-between. The steel tube isolates the cable from impact of excessive friction and crushing under severe loading conditions. The cable lives it own life within the steel tube and is hung-off independent of the hang-off for the umbilical. However, this is not suitable for most underwater umbilicals, and certainly un-reinforced heavy power cables. Indeed, such power cables are not able to withstand their own weight and, because of the gap between the tube and the cable, the tensile load due to the cable weight is not adequately transmitted from the cable to the tube to enable the tube to support the weight of the power cable.

According to one aspect of the present invention there is provided an umbilical for use in the offshore production of hydrocarbons comprising an assembly of functional elements wherein at least one of the functional elements is an electrical cable, and wherein said electrical cable is enclosed within a tube, said tube being adapted to apply a radial compressive force on the electrical cable whereby the tube is capable of supporting the weight of the electrical cable in an axial direction.

Preferably the tube is adapted to apply said compressive load to the outer surface of the electrical cable along wholly or substantially the entire length of the cable.

In a preferred embodiment, said tube is formed from a rigid or substantially rigid material. Preferably the tube comprises a metallic tube, for example a steel tube.

In a second embodiment, the tube comprises a non-ferrous metal tube, for example made of high strength aluminium or copper alloys.

In a third embodiment, the tube comprises a composite material tube, for example a tube comprising carbon fibres, aramid fibres or glass fibres.

The tube may also be a combination of said materials, and/or comprise one or more layers of said materials.

The tube thus acts as a load-bearing layer in a similar way as an armouring outer layer, and increases the axial strength and stiffness of the electrical cable for deep water applications.

The provision of the tube also improves the electrical cable's resistance to axial compression, thus reducing the risk of buckling or kinking of the cable, and increasing the service life of the cable in dynamically loaded umbilicals.

Another advantage of the present invention is that the crushing limit of the umbilical may be increased, thus facilitating the offshore installation of the umbilical using a vertical caterpillar implemented on an installation vessel, known as a "Vertical Laying System". Indeed, the tube wall thickness can be designed to protect the electrical cable from the crushing load applied by the pads of such a caterpillar. It is therefore possible to increase the crush limit of the umbilical, which facilitates its installation at important water depths.

Preferably the tube is wholly or substantially watertight, so that the electrical cable can be designed for a dry environment instead of a flooded one, thus leading to a simplified design and to cost reductions on the cable itself. The tube may also act as an efficient barrier against the diffusion of gas, especially hydrogen, from the outside to the inside of the electrical cable, thus avoiding the detrimental effects of hydrogen gas circulating along the conductors.

The umbilical of the present invention may comprise a plurality of electrical cables, one or more of such electrical cables, preferably each such cable, being enclosed within one or more corresponding tubes, and/or one or more collections or sections of such electrical cables, preferably each such collection or section, being enclosed within one or more corresponding tubes.

According to a further aspect of the present invention there is provided a method of manufacturing an umbilical for use in the offshore production of hydrocarbons comprising an assembly of functional elements wherein at least one of the functional elements comprises an electrical cable, the method comprising at least the step of forming a tight-fitting tube around the electrical cable such that said tube is adapted to apply a radial compressive force on the cable whereby the tube is capable of supporting the weight of the electrical cable in an axial direction.

Preferably the method comprises longitudinally folding a metal sheet around the electrical cable, and joining abutting or adjacent side regions of the sheet together to form said tight fitting tube around said cable.

The method may comprise the further step of reducing the diameter of the tube to apply or to further apply said radial compressive force against the outer surface of the electrical cable. Said step of reducing the diameter of the tube may be achieved by a cold drawing or rolling process, the tube and cable contained therein being drawn through a die or one or more set of rollers.

The method may further comprise providing a filler material between said cable and said tube.

In an alternative embodiment, the cable may be inserted into a pre-formed tube and the required compressive fit achieved by a subsequent reduction in diameter of the tube as described above.

Where the umbilical comprises a plurality of electrical cables including at least one multi-core signal cable and at least one single core power cable, the method may comprise forming a tight-fitting tube around each electrical cable.

Embodiments of the present invention will now be described, by way of example only, and with reference to the accompanying drawings, in which: —

DESCRIPTION OF PREFERRED EMBODIMENTS

Figure 1:
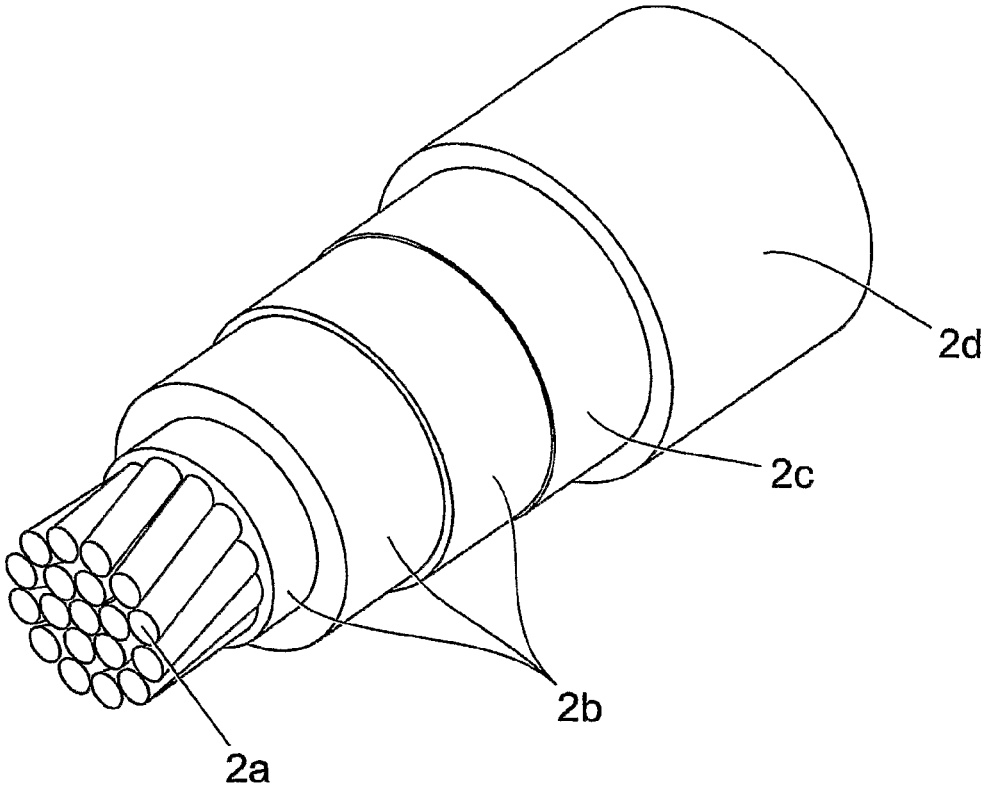
Fig. 1 (Prior Art)
FIG. 1 is a sectional view through a typical prior art power cable.
Figure 2:
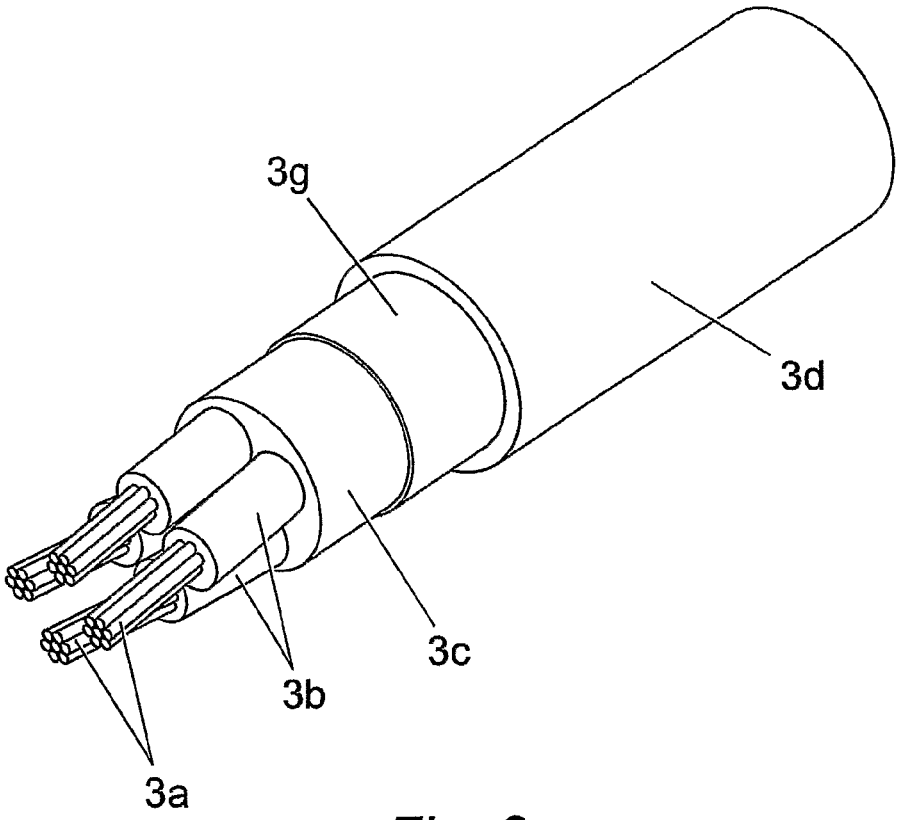
Fig. 2 (Prior Art)
FIG. 2 is a sectional view through a typical prior art quad signal cable.
Figure 3:
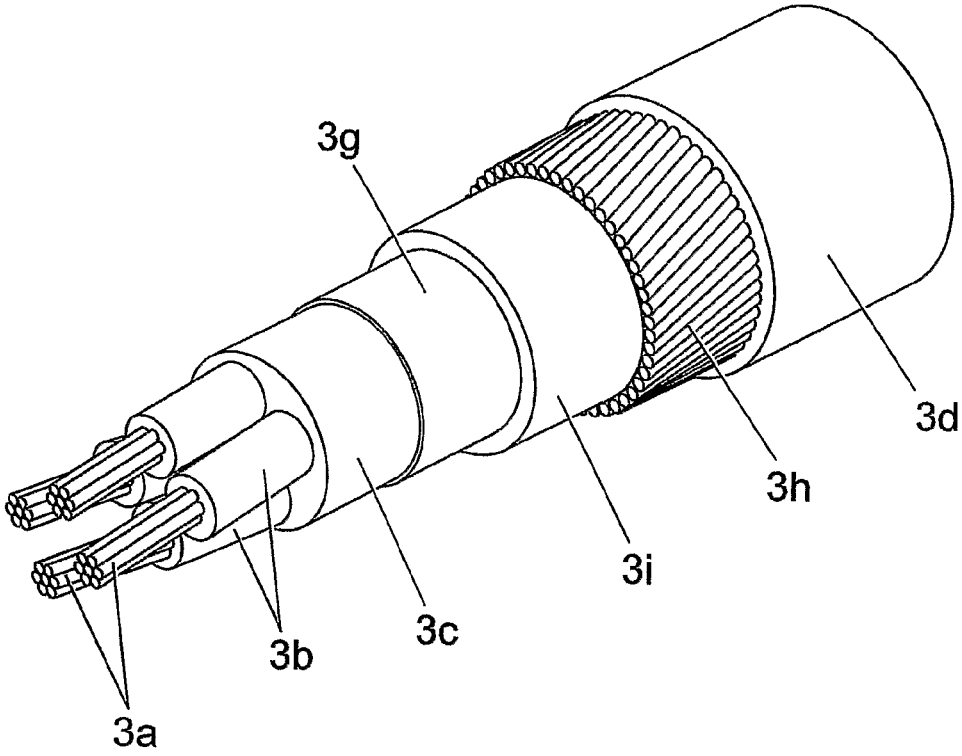
Fig. 3 (Prior Art)
FIG. 3 is a sectional view through the prior art cable of FIG. 2 with an armouring layer.
Figure 4:
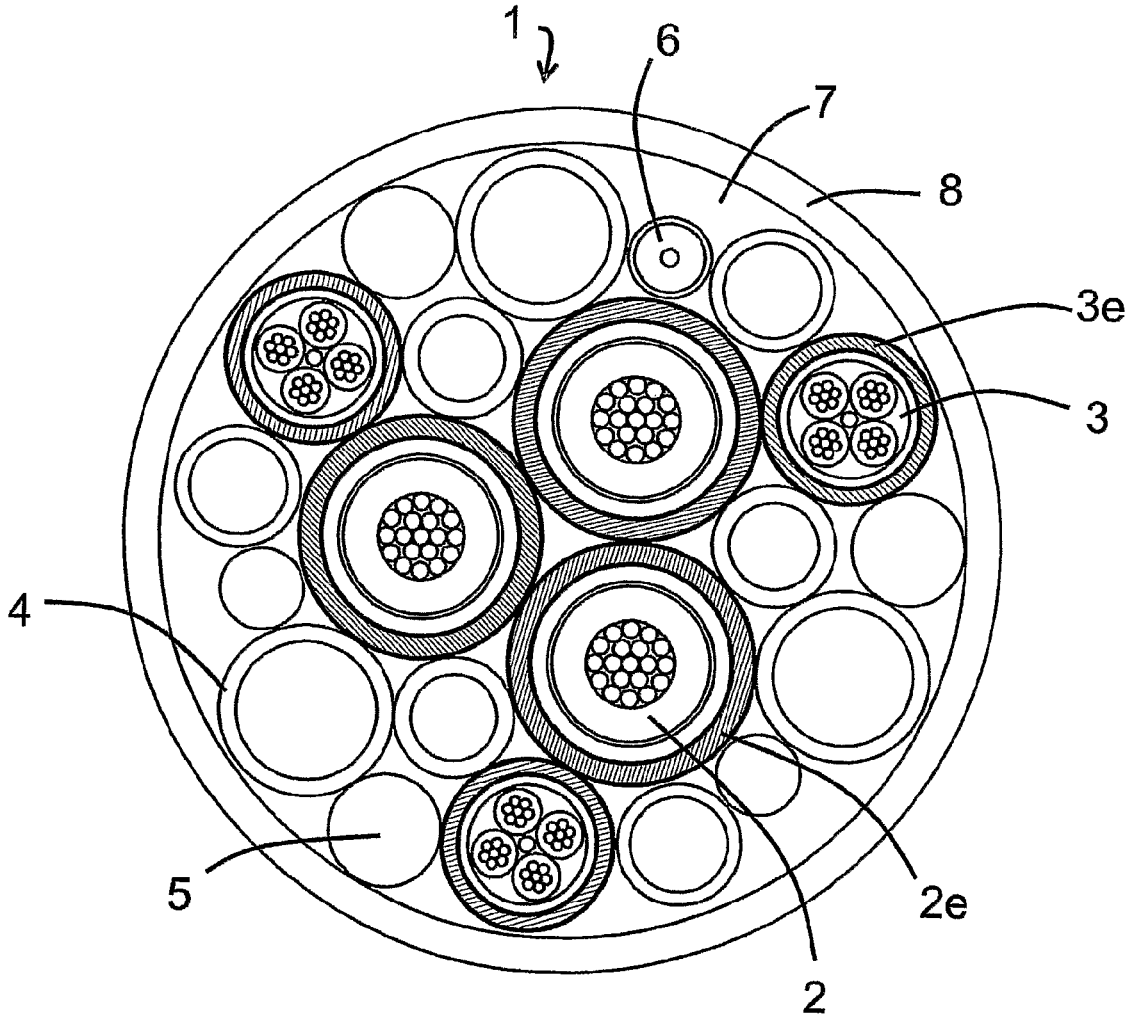
FIG. 4 is a sectional view through a subsea umbilical according to one embodiment of the present invention.

Referring to the drawings, FIG. 4 shows an umbilical 1 in accordance with an embodiment of the present invention comprises an assembly of functional elements including a number of steel pipes or thermoplastic hoses 4, optical fibre cables 6, reinforcing steel or carbon rods 5, electrical power cables 2, and electrical signal cables 3, bundled together with filler material 7 and over-sheathed by a polymeric external sheath 8.

Each power cable 2 in the umbilical 1 of FIG. 4 is individually encased in a protective metallic tube 2*e*, said tubes being a tight fit around the power cables 2 to apply a radial compressive force to the outer surface of the power cables 2. Preferably, each multi-core signal cable 3 in the umbilical 1 is also encased in a similar metallic tube 3*e*.

The present invention therefore applies to individual power conductors, to bundled power conductors (such as a trefoil bundle for a 3-phase power supply), or to a multi-core signal voltage cable, or a combination of same.

In the case of individually protected power cables transporting A.C. currents, the metallic protective tubes 2*e* are preferably made from a non-magnetic metal such as for example a non-magnetic stainless steel, in order to reduce magnetic and eddy current losses.

Figure 7:
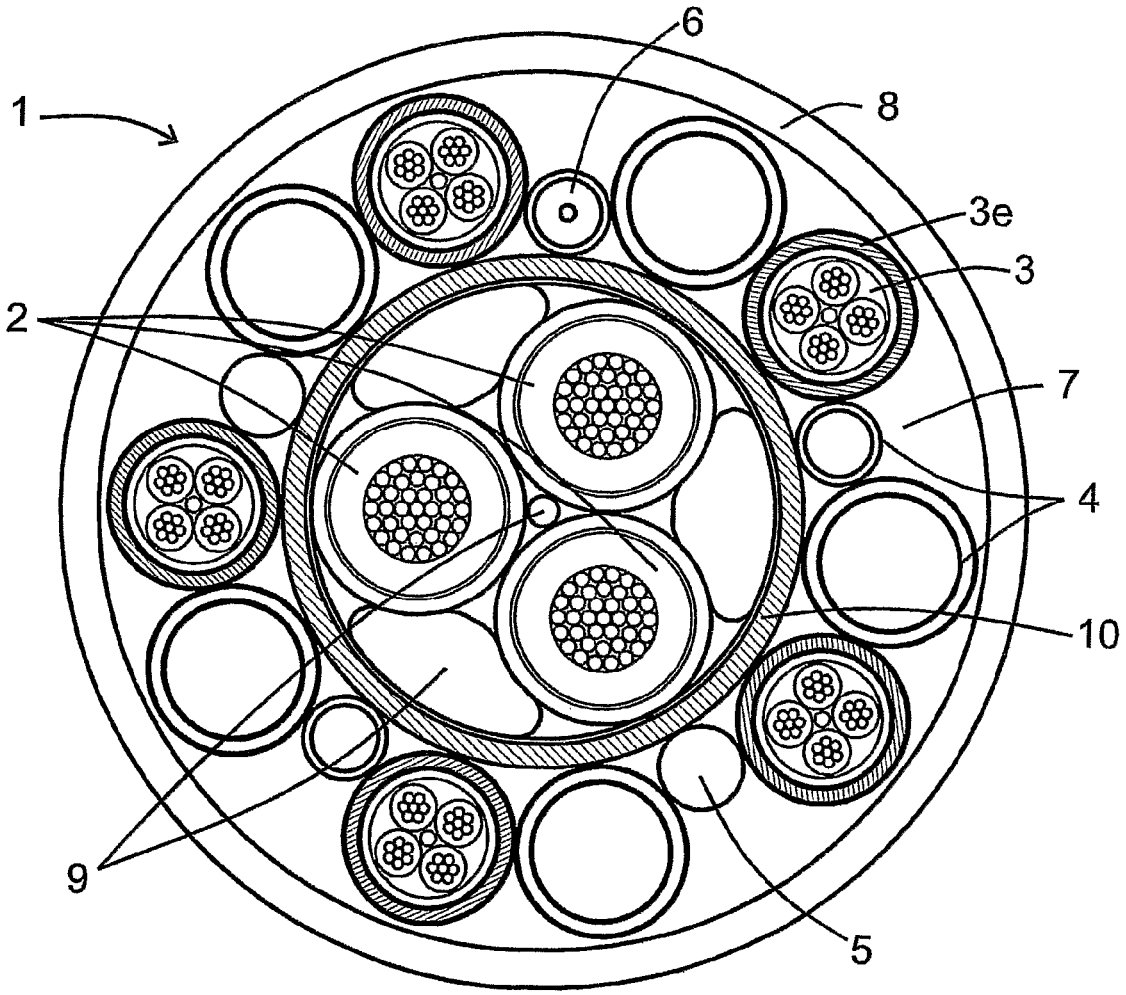
FIG. 7 is a sectional view through a subsea umbilical according to a further embodiment of the present invention.

FIG. 7 illustrates another embodiment of the present invention, where three power cables 2, used for 3-phase power supply for example, are bundled together with filler material 9 and then protected by a single metallic tube 10 encasing and compressing the bundle. The rest of the umbilical structure is similar to that shown in FIG. 4.

In the embodiment illustrated on FIG. 7, using a single metallic tube 10 for protecting a bundle of three power cables 2 transporting 3-phase A.C. currents, the resultant magnetic field at the tube 10 location is very low (as the 3 induced magnetic fields are balancing and cancelling each other), thus making it possible to use either a magnetic or a non-magnetic metal for the tube 10.

The conductors 2*a*, 3*a* of the power and signal cables 2, 3 can preferably be made with materials stronger and lighter than copper such as high strength aluminium for example.

The following are examples of methods of forming a tight-fitting tube around an electrical cable.

Example 1

This manufacturing process comprises three main steps.

During a first step, a metal strip is longitudinally folded around the cable (or the bundle) in order to form a tube. There may be a small overlap at the junction between both sides of the folded strip.

A second step consists in seam-welding the folded strip at the junction/overlap area. The most suitable welding technique is laser welding (providing a reduced heat affected zone, lowering the risk of overheating the cable during the welding process).

Alternatively, other well known welding techniques can be used, such as MIG (Metal Inert Gas) welding, TIG (Tungsten Inert Gas) welding and ERW (Electric Resistance Welding).

A third optional step consists in reducing the tube diameter in order to compress or further compress the outer surface of the cable (or the bundle). This step may be carried out by a cold rolling process, where the protected cable is pulled through a series of suitably spaced and profiled rollers, or a cold drawing process, where the protected cable is drawn through a die. The die reduction should be carefully chosen in order to achieve a suitable compressive effect without damaging or excessively elongating the cable. During this step, the external diameter of the cable (or of the bundled) is slightly reduced, thus achieving a good contact with the surrounding tube.

Preferably, these three steps are carried out in-line to avoid unwanted stretching of the cable.

The contact between an electrical cable and a surrounding tube can be improved by adding one or more intermediate layers between the tube and the cable and/or by adding a filler material between the tube and the cable, for example by filling the tube with a suitable material between said second and third steps.

Figure 5:
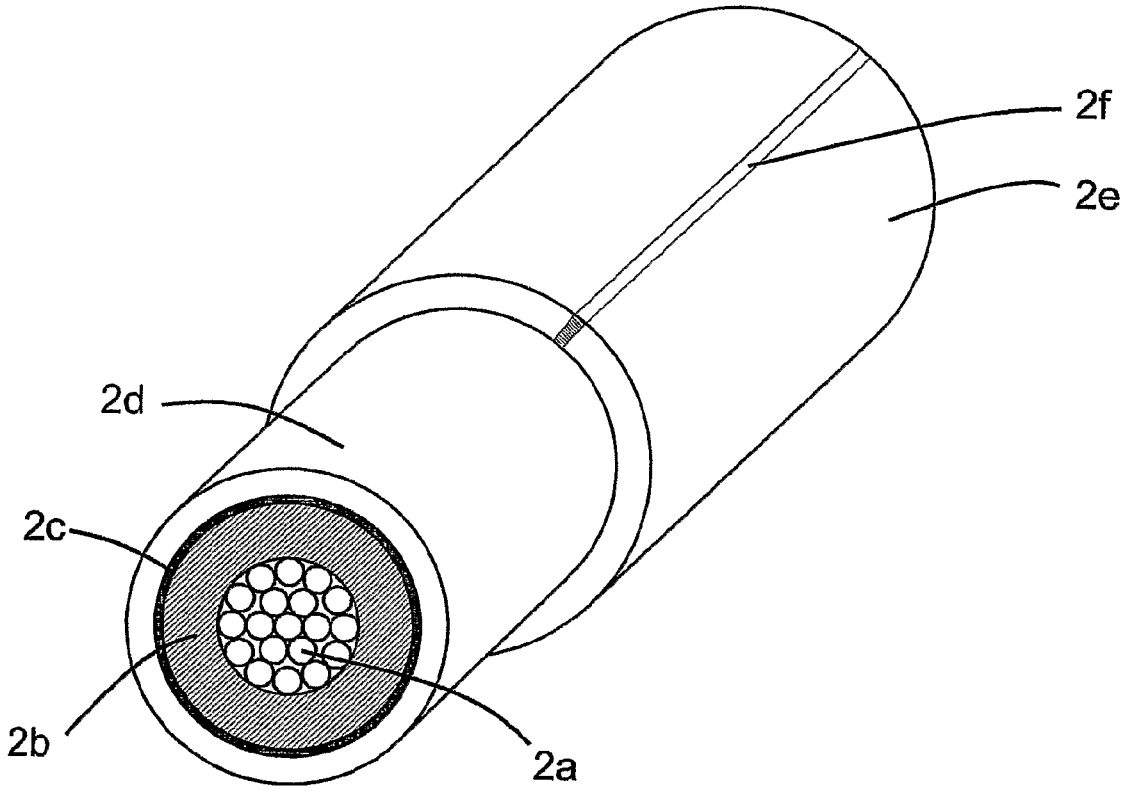
FIG. 5 is a detailed view of a power cable of the umbilical of FIG. 4.
Figure 6:
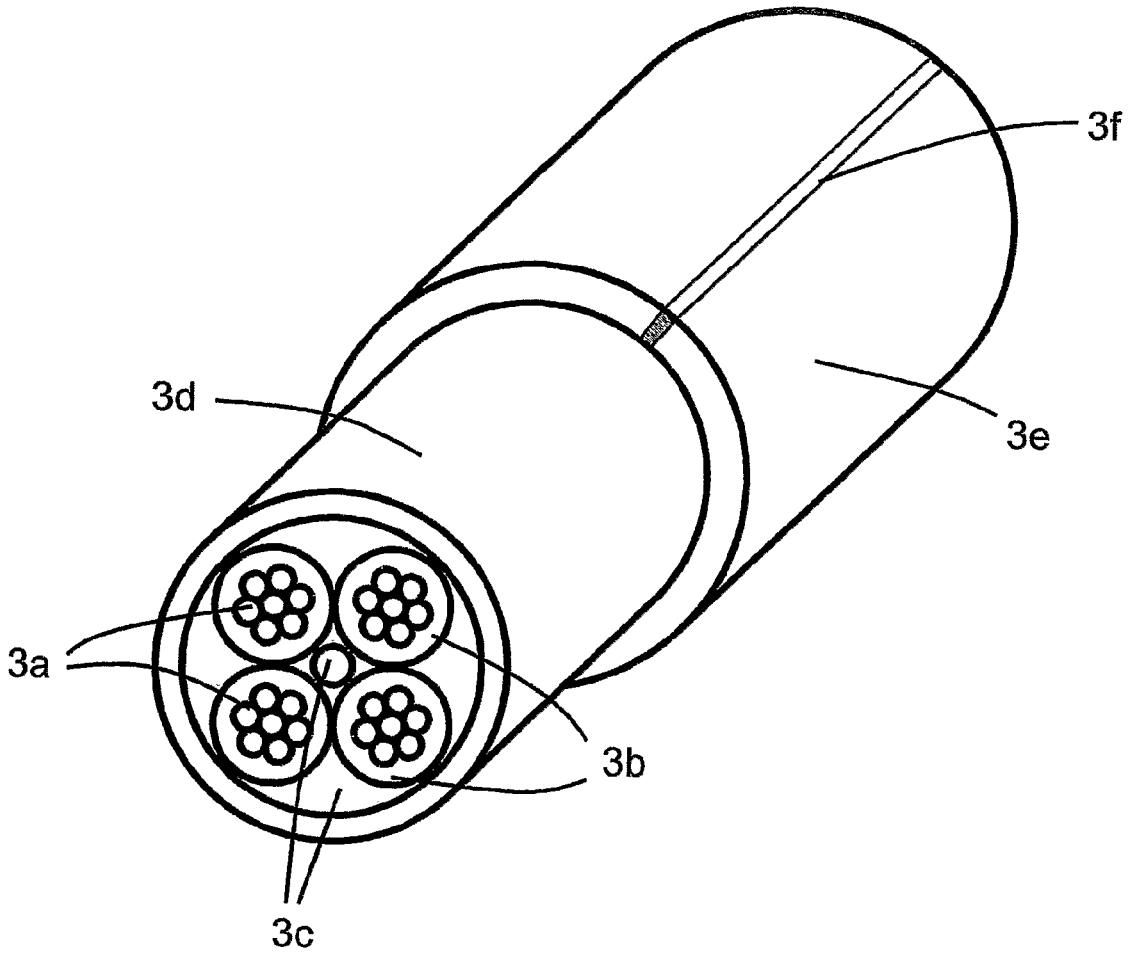
FIG. 6 is a detailed view of a multi-core signal cable of the umbilical of FIG. 4.

FIGS. 5 and 6 respectively illustrate a power cable and a multi-core signal cable protected by metallic tubes 2*e*, 3*e* manufactured according to this process. The seam weld 2*f*, 3*f* extends longitudinally all along the cable.

Example 2

A seamless tube made of a non-ferrous metal with a low melting point, such as aluminium or copper alloys, is directly and continuously extruded around a single electrical cable (FIG. 5) or a bundle of electrical cables (FIG. 6) by using a continuous extrusion process known in the art, such as for example the continuous rotary extrusion process commercialised by Meltech-Confex Limited.

Using such alloys has the advantage of lower processing temperatures. Aluminium copper alloys or copper aluminium alloys also have the advantage of high strength, and of a higher modulus than refined aluminium or copper.

Example 3

A seamless tube made of a composite materials is manufactured directly around the electrical cable/bundle by winding high strength organic fibres (such as carbon or aramid fibres) around the cable, then impregnating the fibres with a resin (composite matrix) such as epoxy and finally curing the assembly in an oven.

Various modifications and variations to the described embodiments of the invention will be apparent to those skilled in the art without departing from the scope of the invention as defined in the appended claims. Although the invention has been described in connection with specific preferred embodiments, it should be understood that the invention as claimed should not be unduly limited to such specific embodiments.

What is claimed is:

1. An umbilical for use in offshore production of hydrocarbons, the umbilical comprising an exterior sheath and an assembly of functional elements positioned inside the exterior sheath, wherein at least one functional element of the assembly of functional elements comprises:

a metallic tube formed from a rigid or substantially rigid material; and an electrical cable enclosed within the tube, said tube being tight fitting and thus applying a radial compressive force on at least a majority of a circumference of the electrical cable along a circumferential region thereof, the tube supporting a weight of the electrical cable in an axial direction, wherein said tube is substantially watertight to maintain a dry environment around the cable.

2. An umbilical as claimed in claim 1, wherein said tube applies said compressive force on the cable along wholly or substantially an entire length of the cable.

3. An umbilical as claimed in claim 1, wherein said tube is a non-ferrous metal tube.

4. The umbilical as claimed in claim 3, wherein the tube is a composite material tube comprising glass fibers.

5. An umbilical as claimed in claim 1, wherein said tube comprises a steel tube.

6. An umbilical as claimed in claim 1, wherein said tube is wholly or substantially impervious to the diffusion of gas, in particular hydrogen, therethrough.

7. An umbilical as claimed in claim 1, wherein the cable comprises a single core power cable.

8. An umbilical as claimed in claim 1, wherein the cable comprises a multi-core cable, such as a signal cable.

9. The umbilical as claimed in claim 8, wherein the multi-core cable is a signal cable comprising a bundle of individual conductors.

10. An umbilical as claimed in claim 1, wherein a filler material is provided between the cable and the tube.

11. The umbilical as claimed in claim 1, wherein the tube is a non-ferrous metal tube made of high strength aluminum.

12. The umbilical as claimed in claim 1, wherein the tube is a non-ferrous metal tube made of copper alloys.

13. The umbilical as claimed in claim 1, wherein the tube is a composite material tube comprising carbon fibers.

14. The umbilical as claimed in claim 1, wherein the tube is a composite material tube comprising aramid fibers.

15. An umbilical as claimed in claim 1, wherein said tube is a tube made of a combination of metal and a composite material.

16. An umbilical as claimed in claim 1, wherein said electrical cable comprises at least one copper conductor.

* * * * *